US006006558A

United States Patent [19]

Peters

[11] Patent Number: 6,006,558

[45] Date of Patent: Dec. 28, 1999

[54] CASH BOX

[75] Inventor: Andrew Charles Peters, Worcestershire, United Kingdom

[73] Assignee: Helix Limited, West Midlands, United Kingdom

[21] Appl. No.: 08/950,069

[22] Filed: Oct. 14, 1997

Related U.S. Application Data

[63] Continuation of application No. 08/433,474, filed as application No. PCT/GB95/00113, Jan. 20, 1994, abandoned.

[30] Foreign Application Priority Data

Jan. 26, 1994 [GB] United Kingdom ..... 9401486

[51] Int. Cl.[6] ..... E05B 65/52

[52] U.S. Cl. ..... 70/63; 70/71; 70/159; 109/53; 220/528; 292/89; 292/108; 292/DIG. 37; 292/DIG. 38

[58] Field of Search ..... 70/63, 70, 71, 70/69, 159–162; 292/89, DIG. 37, 87, DIG. 38, 108, 153, 210; 220/528; 109/53

[56] References Cited

U.S. PATENT DOCUMENTS

| | | | |
|---|---|---|---|
| 1,022,817 | 4/1912 | Binkley | 70/71 X |
| 1,132,824 | 3/1915 | Binkley | 70/71 |
| 1,379,839 | 5/1921 | Skóra | 70/70 X |
| 2,410,475 | 11/1946 | Anderson . | |
| 2,426,754 | 9/1947 | Thiele | 70/70 |
| 2,624,191 | 1/1953 | Boden et al. | 70/70 |
| 2,664,735 | 1/1954 | Vahlstrom et al. | 292/89 X |
| 2,880,603 | 4/1959 | Swanson | 70/70 |
| 3,044,287 | 7/1962 | Pelcin | 292/DIG. 37 X |
| 3,285,681 | 11/1966 | Niederer . | |
| 3,589,554 | 6/1971 | Smith | 220/23.83 |
| 3,786,913 | 1/1974 | Crawford | 220/528 X |
| 4,098,199 | 7/1978 | Haje | 109/52 |
| 4,206,343 | 6/1980 | Mousel | 219/387 |
| 4,306,431 | 12/1981 | Craig | 292/DIG. 37 X |
| 4,314,650 | 2/1982 | Cillario | 220/23.83 |
| 4,435,966 | 3/1984 | Craig | 292/DIG. 37 X |
| 4,474,116 | 10/1984 | Castenada, Jr. et al. | 109/51 |
| 4,630,852 | 12/1986 | White et al. | 292/DIG. 37 X |
| 4,807,776 | 2/1989 | Cortopassi | 220/23.83 |
| 4,878,592 | 11/1989 | Lee | 220/23.83 |
| 5,348,144 | 9/1994 | Maier | 220/528 X |

FOREIGN PATENT DOCUMENTS

| | | |
|---|---|---|
| 0 086 870 | 8/1983 | European Pat. Off. . |
| 0 345 976 | 12/1989 | European Pat. Off. . |
| 319161 | 11/1902 | France . |
| 2 165 563 | 8/1973 | France . |
| 1 584 287 | 3/1970 | Germany . |
| 17 82 869 | 4/1976 | Germany . |
| 36 06 510 A1 | 9/1987 | Germany . |
| 649 602 A5 | 5/1985 | Switzerland . |
| 290829 | 5/1928 | United Kingdom . |
| 1548981 | 7/1979 | United Kingdom . |
| 2 155 443 | 9/1985 | United Kingdom . |

*Primary Examiner*—Lloyd A. Gall
*Attorney, Agent, or Firm*—Pillsbury Madison & Sutro LLP

[57] ABSTRACT

FIG. 2 shows a cash box 1 provided with a hinged lid 2. The internal width and length dimensions of the lid 2 are slightly larger than the external length and width dimensions of the base 4 to provide a snug, overhanging fit. Lid 2 has a downwardly depending lip 2*a* with plain free edge and box 4 has a non-joggled plain free edge 4*a* with opposed side wall portions 4*b* and 4*c* having indented support portion 4*e* and 4*f*, to support flange portions 6*a* and 6*b* of coin tray 6. The cash box 1 has a key operated locking mechanism with rotatable locking tongue 9 and a push button operated catch means 11 including flat square spring portion 11*b* mounted on shaft S of the locking mechanism 8.

28 Claims, 4 Drawing Sheets

CASH BOX

This is a continuation of application Ser. No. 08/433,474, filed on May 8, 1995, now abandoned, which was abandoned upon the filing hereof which is a 371 of PCT/GB95/00113, filed on Jan. 20, 1995.

BACKGROUND OF THE INVENTION

This invention relates to a cash box more particularly of a type having a base and a lid with a coin tray in the box.

It is known for cash boxes to be produced with the lid and base being from the same die tool and thus having substantially identical, external, width and length dimensions. It is known to provide a peripheral seal interposed between the lid and the base, thereby permitting both the lip of the lid (top part) and the lip of the base (bottom part) to be provided by a plain free edge which facilitates manufacture. In a previous design of the Applicant (see Patent Application No. 2155443A—the disclosure content of which is hereby incorporated by reference) the peripheral seal is integral with a coin tray and in another previous design of the Applicant (see Patent Application No. 8813580.1—the disclosure content of which is hereby incorporated by reference) the coin tray is separate to the peripheral seal. In both designs, disadvantageously, it is possible in some instances for damage to occur to the seal or coin tray because the seal is sandwiched in between the lid and base and the seal projects beyond the external width and length of the lid and the coin tray/seal is usually made of plastics which is breakable.

Other designs of cash box not involving a peripheral seal, but having a lid and base formed from the same die tool generally require the lip on the base to be deformed inwardly in a stepped manner (joggled) to provide an overlap and seat for the lid in order to provide an outward appearance of a flush fitting of the lid and base. Such a "joggling" operation tends to be laborious and relatively expensive.

Also, previous designs of cash box have involved a key operated cylinder lock having a notched tongue rotatable with the barrel of the lock to a locking position in which the notch engages over a locking bar on the underside of the lid. Thus, the closed position of the lid relative to the base is only maintained by the key operated lock mechanism. However, it is believed that it is possible to improve the versatility of such a locking mechanism and that to be able to retain the lid in the closed position on the base by means of the key operated lock mechanism alone tends to be disadvantageous in some instances.

SUMMARY OF THE INVENTION

It is an object of the present invention to at least alleviate one or more of the aforementioned, or other, disadvantages associated with cash boxes.

According to the present invention there is provided a cash box comprising a base and a lid releasably lockable thereto by a locking mechanism, said box having a lid with some larger dimensions than the base so that a lip of the lid overhangs or overlaps a lip of the base when the box is in a closed position, the lip of the base being provided with a plain free edge or non-joggled edge, and preferably opposed wall portions of said box at or near said lip being indented or provided with inwardly directed ledge means for supporting the flange of a coin tray to be received in the cash box.

Usually, the lid will have external width and length dimensions which are slightly larger than the external width and length dimensions of the base so that the lid is a tight, snug overhanging fit with the base. Thus, usually, the internal width and length dimensions of the lid will match or be very slightly larger than the external width and length dimensions of the base, more particularly near said edge.

The lid will usually be hinged to the base and the lid and base will usually be of the same thickness of material.

In one embodiment of the present invention opposed side wall portions (rather than front or rear wall portions) are indented along said lip for a substantial part of, or most of the length of, the respective side wall of the base, in order to provide said ledge means for supporting the flange of a coin tray.

Preferably, the cash box is provided with a locking mechanism and a button operated (usually push button) catch means operable to retain the lid to the base in a closed position. The catch means may be integrally formed and may be mounted on the axis of the locking mechanism. The catch means may have a catching tongue cooperable with a locking plate or other means on the lid, said catching tongue being connected to a catch spring portion flexible into and out of a catching position by means of said button, while the locking mechanism is in an open position.

Many other advantageous features of this aspect of the present invention will be apparent from the following description and drawings.

According to a further aspect of the present invention there is provided a cash box comprising a base and a lid releasably lockable thereto by a locking mechanism, said box including a button operated catch means operable to retain the lid to the base in a closed position, the arrangement being such that with the locking mechanism in an open position the lid can be retained to the base by said catch means and said locking mechanism can be operated to lock the box while the box is in the closed position, said button operated catch means being operable to open the box only while the locking mechanism is in an open position, the locking mechanism preferably disabling the catch means from being disengaged from a catching position when the locking mechanism is in a closed position.

In one embodiment of the cash box in accordance with this aspect of the present invention, the button operated catch means may comprise a press button which is, preferably, formed integrally with a catch spring portion and catching tongue portion. The catch mechanism may be connected on the same axis as the locking mechanism and the press button may extend through a receiving hole in a front wall portion of the base, preferably Just above the locking mechanism.

Preferably, pressing the button of the catch means while the box is closed, and while the locking mechanism is in an open position, will act to flex catching spring portion about a flexing axis to disengage catching tongue from catching means (for example a locking plate on the underside of the lid) to allow the box to be opened. The catch spring portion may be a generally square C-shaped portion preferably integrally formed with an inner square portion mounted on a main shaft of the locking mechanism and held firmly against an inner face of the front wall portion of the base of the box. The catching tongue is, preferably, offset to one side of the button. The locking mechanism is, preferably, provided with a rotatable locking tongue which partially overlaps the catching tongue and/or spring portion of the catch means, when the locking mechanism is in the locked position, thus preventing disengagement of the catching tongue from the locking plate (or other catch means) on the lid. Also, preferably, the locking tongue is provided with a locking notch which is able to engage a, or the, locking plate on the lid.

Still further according to the present invention there is provided a cash box comprising a base and a lid releasably lockable thereto by a locking mechanism, said cash box having one or more of the following features:

(a) a lid cooperating with a base having a lip formed with a non-joggled edge adjacent a plain free edge of the lid in a closed position, (b) a lid having external length and width dimensions larger than the external length and width dimensions of the base, (c) a base having a lip with a non-joggled edge and provided with indented opposed wall portions forming ledge means supporting a flange of a coin tray to be received in the cash box, or said opposed wall portions being provided with inwardly directed ledge means, (d) the lid being retained to the base by button operated catch means which may be operated to open the box once the locking mechanism has been moved to an open position, (e) push button catch means provided with the button being on the base of the box and said button preferably being integrally connected to a catch spring portion that can be flexed to urge a catching tongue into and out of engagement with catching means on the lid of the box, (f) catch means comprising a flat plate spring portion connected to the barrel of a locking mechanism, said spring portion being integral with an (offset) catching tongue that can be urged into and out of engagement with catching means on the lid by means of a button, (g) any advantageous feature derivable from the following description and drawings.

Still further according to the present invention there is provided a method of making a cash box having a base and a lid releasably lockable thereto by a locking mechanism, said method comprising:

(a) forming said base and lid from different die tools, then connecting said base and lid together such that a lip of the lid overhangs or overlaps the lip of the base with said lip being provided with a non-joggled edge.

BRIEF DESCRIPTION OF THE DRAWINGS

An embodiment of the present invention will now be described by way of example only, with reference to the accompanying drawings in which.

DESCRIPTION OF THE PREFERRED EMBODIMENT

Figure 1:
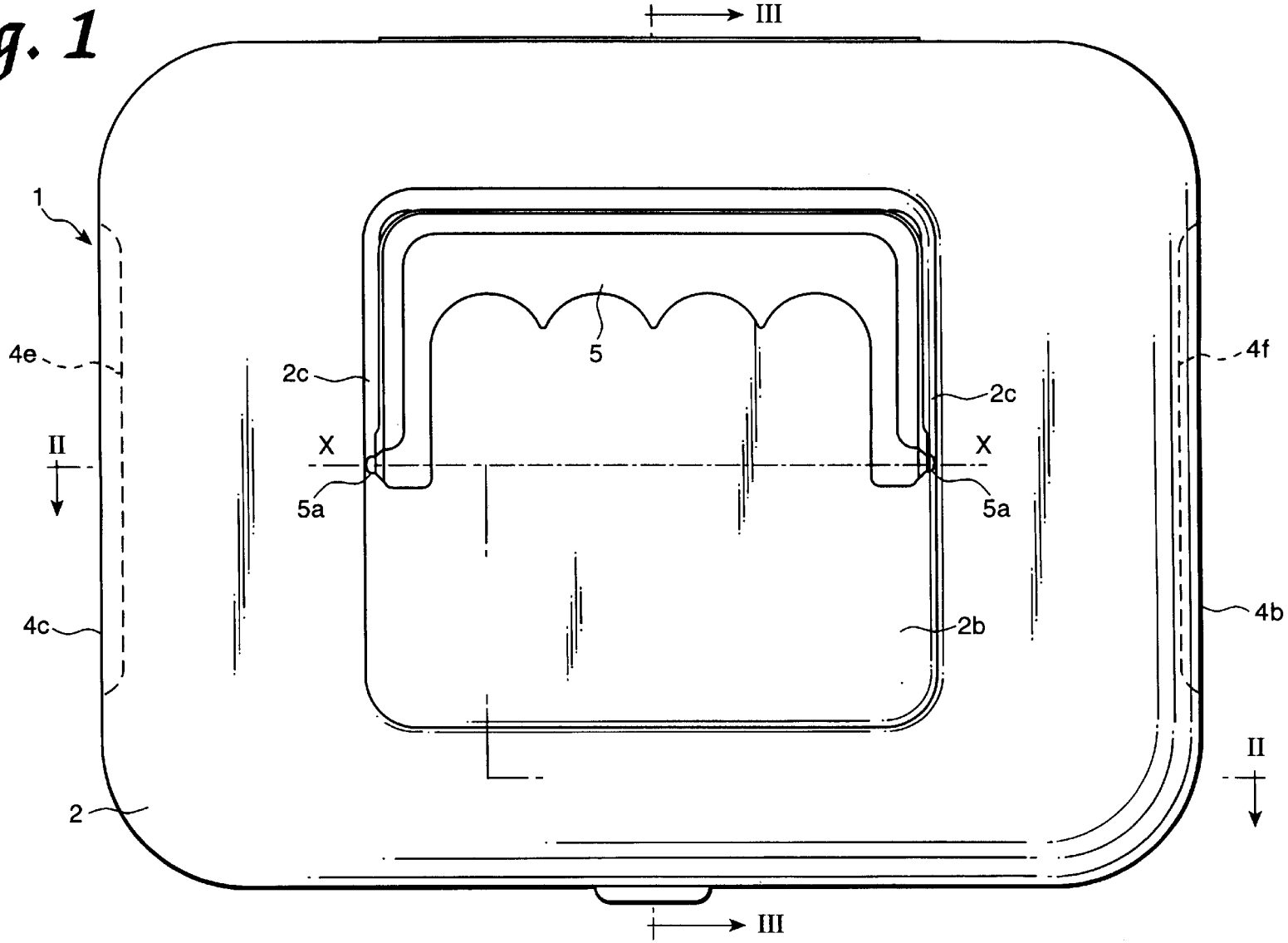
FIG. 1 shows a plan view of the cash box.

Referring to the FIGURES of the drawings, a metal cash box 1 is provided with a lid 2 hinged about axis 3 (see FIG. 3) to a base 4. Lid 2 has been deep drawn from a different die tool (not shown) than that used for base 4 so that the lid is of slightly larger external width and length dimension to the base. Additionally, the internal width and length dimensions of the lid 2 are very slightly larger than the external length and width dimensions of the base 4 so that the lid is a tight, snug overlapping or overhanging fit with the bass, as shown more particularly in FIG. 2. The lid 2 is provided with a downwardly depending lip 2*a* provided by a plain free edge which facilitates manufacture of the lid, and the upper surface of the lid 2 itself is provided with a generally rectangular recess 2*b* (see FIG. 1) receiving a plastics handle 5, in a manner which is generally known per se, the handle being arranged to rotate about axis X—X by means of handle spigot portions 5*a* engageable in opposed wall portions 2*c* of the recess 2*b* (see FIG. 2).

The base 4 is provided with an upwardly depending plain free edge 4*a* (rather than a joggled edge) and opposed side wall portions 4*b* and 4*c* of the cash box are provided with indented portions 4*e* and 4*f* on said lip 4*a* which extend inwardly of the base (to form inwardly directed ledge means) in order to support opposed flange portions 6*a* and 6*b* (see FIG. 2) of coin tray 6 which is received inside the cash box 1.

Figure 2:
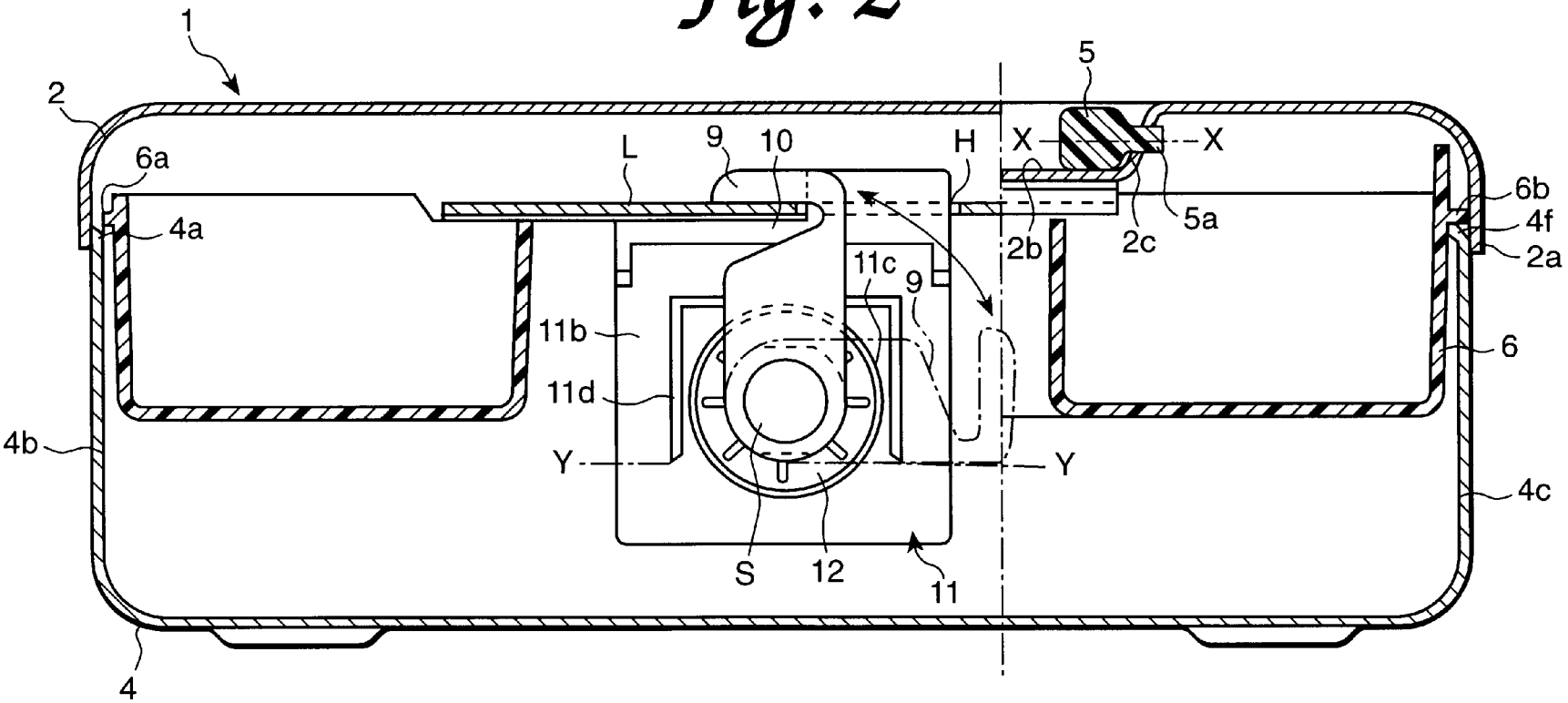
FIG. 2 shows a rear sectional view of the cash box taken on the stepped line II—II of FIG. 1.
Figure 4:
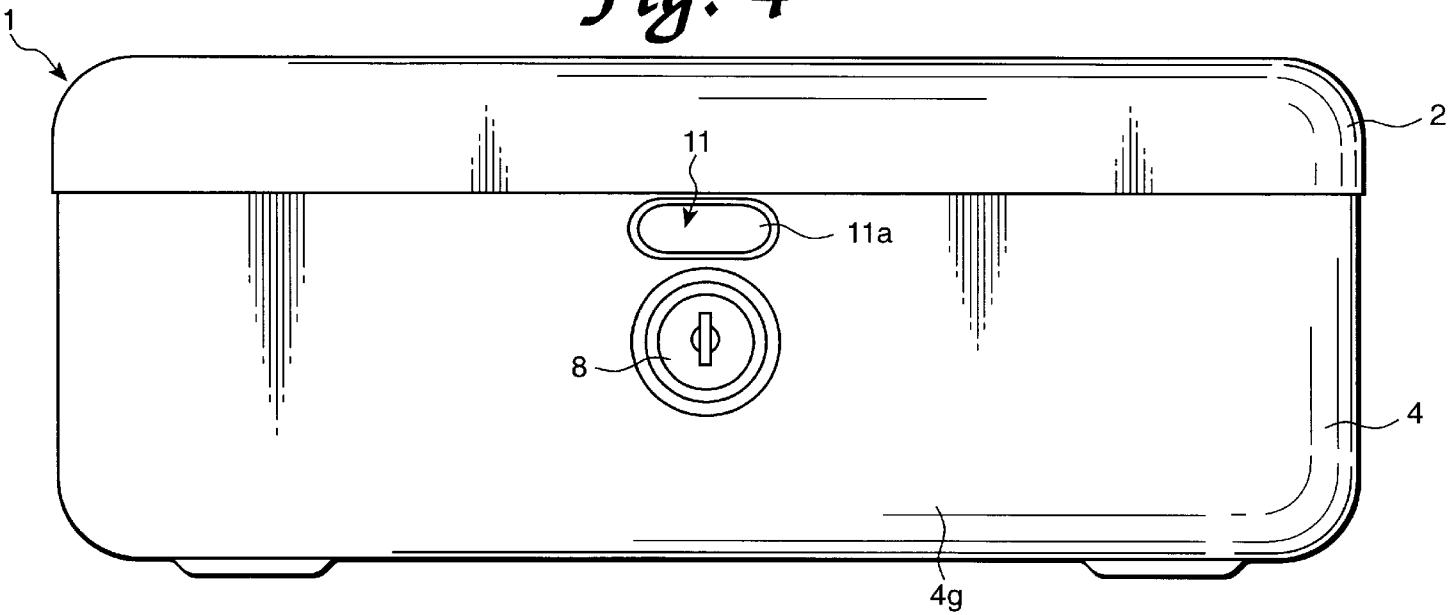
FIG. 4 shows a front view of the cash box.

The cash box 1 is provided with a key operated locking mechanism 8 (see FIG. 4) having a rotatable locking tongue 9 with notch 10 generally of a form known per se (see FIG. 2—tongue 9 rotatable in either direction of double headed swing arrow). Advantageously, the cash box 1 is also provided with a push or press button operated catch means or mechanism 11 which is integrally moulded in plastics and has a press button portion 11*a* (of generally oval shape) projecting through a generally oval aperture in the front wall 4*g* of the base 4 positioned just above the key operated lock 8. The catch mechanism 11 includes a flat generally square spring portion 11*b* integral with an inner generally flat square portion 11*c* (defined in part by square C-shaped slot lid) mounted on the main shaft S of the lock mechanism 8 and held firmly against the inner face of the front wall portion 4*g* by a starlock washer 12, which normally (i.e. in prior art arrangements) seats directly against said inner face. Thus, the catch mechanism 11 has square portion 11*c* held tightly to the said inner face, said portion 11*c* also being held against rotational movement. Catch spring portion 11*b* is generally C-shaped and is able to flex relative to portion 11*c* about flexing axis Y—Y.

Figure 3:
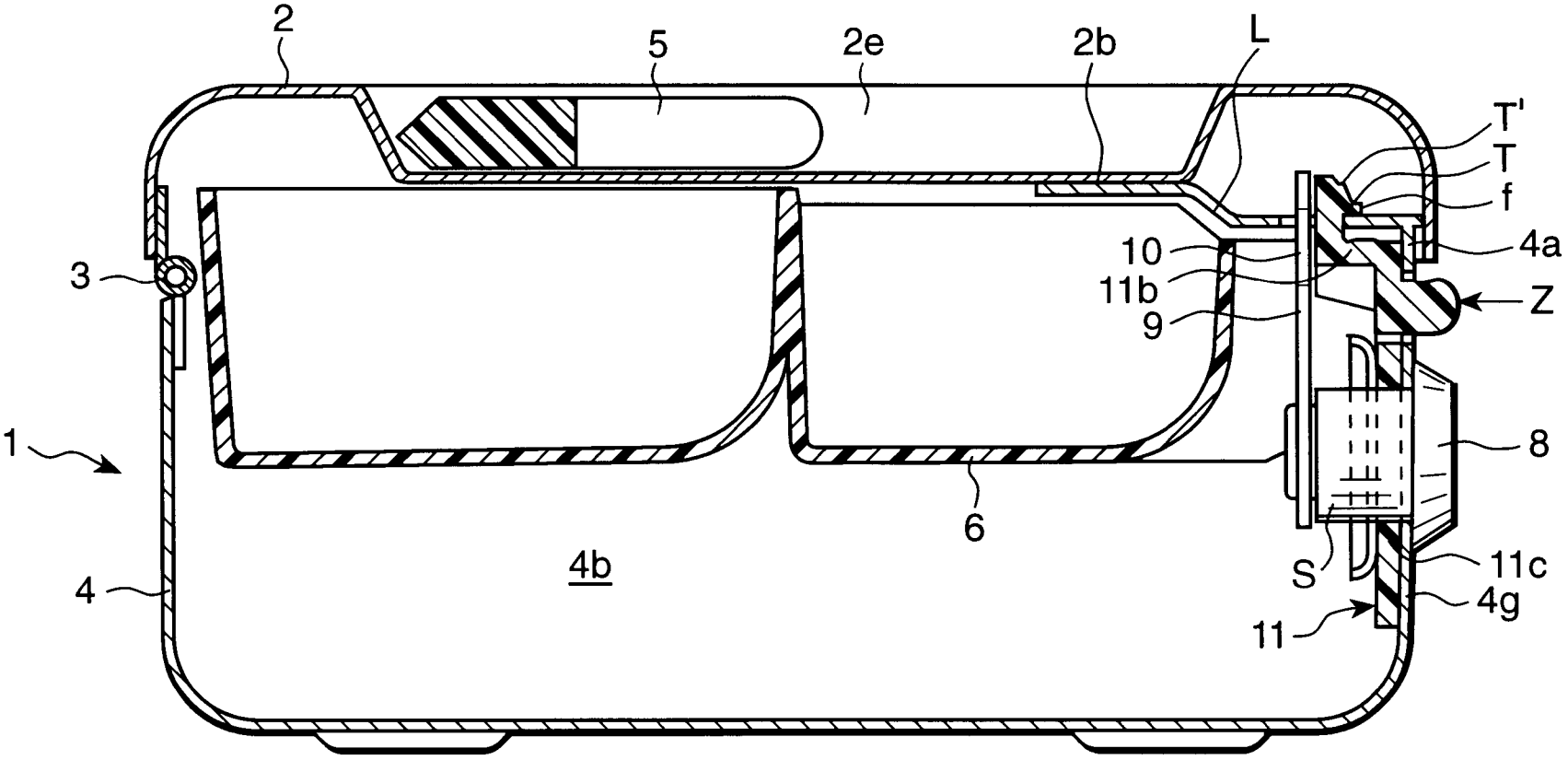
FIG. 3 shows a sectional view of the cash box taken on line III—III of FIG. 1.
Figure 5:
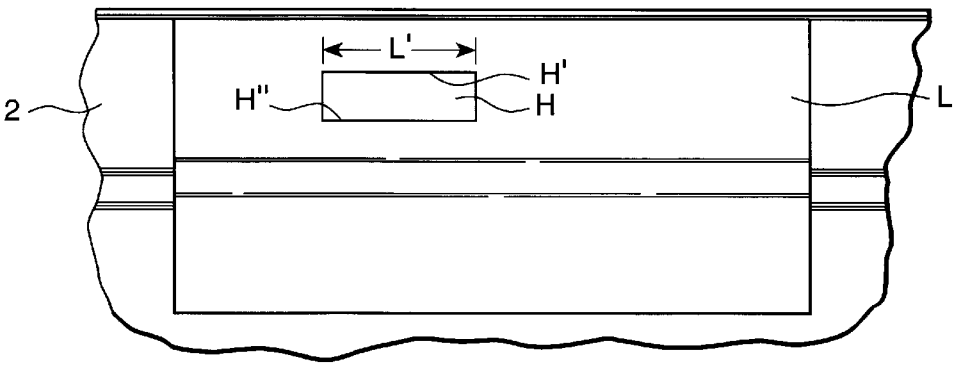
FIG. 5 shows a detailed view of a locking plate on the underside of the lid of the box.

As should be evident from FIG. 3, spring portion 11*b* is provided with an offset, upwardly depending, tapered or wedge shaped catching tongue portion T which in the closed position has been passed (resiliently snapped) through a rectangular hole H in locking plate L provided on the underside of the lid 2 (see FIG. 5) such that a front flange f of the tongue T engages over the front edge H' of the locking plate L which defines in part the hole H (see FIG. 3). Tongue T is connected to spring portion lib by integral horizontally extending portion 11*d*. As shown in FIG. 2, locking tongue 9 of the locking mechanism is also received through the hole H in such a manner that a portion of the plate L lies securely in the notch 10. The plate L engages in the notch 10 as the barrel of the key operated lock 8 is rotated clockwise to lock the box 1 in the closed position, as should be evident from the FIGURES of the drawings.

The locking tongue 9, in the closed position as shown in FIG. 3, partially overlaps the tongue T from behind, thus preventing disengagement of the tongue T from the locking plate L by pushing on the button 11*a* in direction Z as shown in FIG. 3, since the tongue 9 is a stiff metal plate and spring portion 11*b* is thus prevented from flexing about axis Y—Y. However, once the lock mechanism 8 has been moved to the open position (clockwise about double-headed swing arrow in FIG. 2 as shown in chain dotted lines) the locking tongue 9 no longer overlaps the catching tongue T (tongue 9 is approximately at right angles to the full line position shown in FIG. 2) so that pushing on the press button 11*a* in the direction of arrow Z will cause the spring catch portion 11*b* to flex about flexing axis Y—Y, thereby disengaging flange f from edge H' and thereby allowing the lid 2 to be opened relative to the base 4 while the press button portion 11*a* is depressed. Should the press button 11*a* be released while the lid 2 is still in the closed position relative to the base 4, then the spring catch portion 11*b* will flex back about flexing axis Y—Y allowing flange f to locate over edge H' thereby retaining the lid to the base. Thus, the box 1 cannot be opened by operation of press button 11*a* while the key operated locking mechanism 8 is in the locked position (i.e. while tongue 9 is in the position shown in FIG. 2). It should also be noted that in an alternative embodiment, no locking notch need be provided in the locking tongue which engages with a locking plate since a locking tongue need only be provided which prevents rearward pivoting movement of the catching tongue T about axis Y—Y when pressing on press button 11*a*. However, it is to be noted that in the present embodiment locking tongue 9 effectively provides a double locking action. The first locking action is provided by the engagement of the locking plate L in the notch 10 of the locking tongue 9 and the second locking action is provided by the locking tongue 9 preventing any rearward pivotal movement of the catch tongue T (which itself, therefore, acts as a locking tongue) or indeed any movement of the spring portion 11*b* about the flexing axis Y—Y.

Advantageously, locking plate L is of a substantial length to avoid any unnecessary "rocking" of the lid relative to the base along the length dimension when the box is closed (i.e. to act as a stabiliser). As should be evident from the FIGURES, in closing the lid 2 of the box, while the locking mechanism is in the open position, edge H' acts as a cam against the sloping surface T' which causes catch portion 11*b* to flex rearwardly about axis Y—Y until flange f snaps over said edge retaining the lid to the base. Also, since the press button 11*a* is received in a hole 11*a* sized to be smaller than the width of a finger, the front wall portion 4*g* surrounding said hole acts as a stop (when the pressing finger engages same) preventing the catch spring from being flexed too far (e.g. to breaking point) about axis Y—Y if, for example, the box is in an open position. When the box is closed but the locking mechanism open, edge H" of the hole H may also act as a stop preventing undue flexing of the catch portion.

Advantageously, locking plate L also engages the coin tray in the closed position to restrain any rattling of the tray.

It is to be understood that the scope of the present invention is not be unduly limited by the particular choice of terminology and that a specific term may be replaced by any equivalent or generic term. For example, the term "joggled" could be replaced by "stepped". The term "mechanism" could be replaced by "means". Further, it is to be understood that individual features, method or functions relating to the cash box or catch mechanism and/or combinations thereof might be patentably inventive. The singular may include the plural and vice versa.

I claim:

1. A cash box comprising:

a deep drawn base having a lip, a deep drawn lid having a lip, and a locking mechanism releasably locking said lid to said base, said lid having internal width and length dimensions that are substantially identical to or are slightly larger than external width and length dimensions of the base so that the lip of the lid overhangs the lip of the base and forms a tight, snug overhanging fit with the base when the box is in a closed position, the lip of both the lid and base being provided with a non-joggled edge, and in which opposed wall portions of said box near said lip of the base are indented for supporting the flange of a coin tray to be received in the cash box.

2. A cash box as claimed in claim 1, wherein the lid is hinged to the base.

3. A cash box as claimed in claim 1, wherein the lid and base are of the same thickness of material.

4. A cash box as claimed in claim 1, wherein said wall portions are indented along said lip for a substantial part of the opposed wall portions of the base, in order to provide means for supporting the flange of a coin tray.

5. A cash box as claimed in claim 1 further comprising:

a button operated catch means separate from the locking mechanism, operable to retain the lid to the base in a closed position, thereby providing a double locking action.

6. A cash box as claimed in claim 5, wherein the catch means is integrally formed.

7. A cash box as claimed in claim 6, wherein the catch means is mounted on an axis of the locking mechanism.

8. A cash box as claimed in claim 5, wherein the catch means has a catching tongue co-operating with a locking means on the lid, said catching tongue being connected to a catch spring portion flexible into and out of a catching position by means of said button, while the locking mechanism is in an open position.

9. A cash box as claimed in claim 5 wherein said locking mechanism is positioned within the interior of the cash box.

10. A cash box according to claim 5 wherein the cash box is constructed and arranged such that with the locking mechanism in an open position the lid can be retained to the base by said catch means and said locking mechanism can be operated to lock the cash box while the cash box is in the closed position, said button operated catch means being operable to open the box only while the locking mechanism is in an open position and in which the catch means is connected on the same axis as the locking mechanism.

11. A cash box as claimed in claim 1, wherein the lip of the lid overhangs indented parts of the opposed wall portions.

12. A cash box comprising:

a base, a lid, a locking mechanism positioned within the interior of the cash box releasably locking said lid to said base, and a button operated catch means comprising a press button separate from the locking mechanism, both said locking mechanism and catch means operable to retain the lid to the base in a closed position, to provide a double locking action, the cash box being constructed and arranged such that with the locking mechanism in an open position the lid can be retained to the base by said catch means and said locking mechanism can be operated to lock the cash box while the cash box is in the closed position, said button operated catch means being operable to open the box only while the locking mechanism is in an open position and in which the catch means is connected on the same axis as the locking mechanism.

13. A cash box as claimed in claim 12, wherein the locking mechanism is constructed and arranged to disable the catch means from being disengaged from a catching position when the locking mechanism is in a closed position.

14. A cash box as claimed in claim 12, wherein the press button is formed integrally with a catch spring portion and catching tongue portion.

15. A cash box as claimed in claim 14, wherein the catch spring portion is constructed and arranged such that pressing the button of the catch means while the box is closed, and while the locking mechanism is in an open position, will act to flex the catch spring portion to disengage the catching tongue portion from a catch means to allow the box to be opened.

16. A cash box as claimed in claim 15, wherein the catch means is a locking plate on the underside of the lid.

17. A cash box as claimed in claim 14, wherein the catch spring portion is a generally square C-shaped portion.

18. A cash box as claimed in claim 17, wherein the catch spring portion is integrally formed with an inner square portion mounted on a main shaft of the locking mechanism and held firmly against an inner face of a front wall portion of the base of the box.

19. A cash box as claimed in claim 18, wherein the catching tongue portion is offset to one side of the button.

20. A cash box as claimed in claim 17, wherein a locking means is provided with a rotatable locking tongue which partially overlaps the catching tongue portion and the catch spring portion of the catch means, when the locking mechanism is in the locked position.

21. A cash box as claimed in claim 20, wherein the locking tongue is provided with a locking notch which is able to engage a locking plate on the lid.

22. A cash box as claimed in claim 12, wherein the press button extends through a receiving hole in a front wall portion of the base.

23. A cash box as claimed in claim 22, wherein the receiving hole is generally above the locking mechanism.

24. A cash box according to claim 12 wherein said base has a lip and said lid has a lip, said lid having internal width and length dimensions that are substantially identical to or are very slightly larger than the external width and length dimensions of the base so that the lip of the lid overhangs the lip of the base and forms a tight, snug overhanging fit with the base when the box is in a closed position, the lip of both the lid and base being provided with a non-joggled edge, and in which opposed wall portions of said box near said lip of the base are indented for supporting the flange of a coin tray to be received in the cash box.

25. A cash box comprising:

a base having a lip, a lid having a lip, a locking mechanism positioned within the interior of the cash box releasably locking said lid to said base, and a button operated catch means comprising a press button, separate from the locking mechanism, both said locking mechanism and catch means operable to retain the lid to the base in a closed position, to provide a double locking action, said lid having internal width and length dimensions that are substantially identical to or are very slightly larger than the external width and length dimensions of the base so that the lip of the lid overhangs the lip of the base and forms a tight, snug overhanging fit with the base when the box is in a closed position, the lip of both the lid and base being provided with a non-joggled edge.

26. A cash box as claimed in claim 25 which opposed wall portions of said box near said lip of the base are indented for supporting the flange of a coin tray to be received in the cash box.

27. A cash box comprising:

a base having a lip, a lid having a lip, a button operated catch means, a locking tongue inside the box, and a locking mechanism releasably locking said lid to said base, wherein said locking mechanism comprises a lock cylinder inserted from the outside of the box through an aperture in said base, and in which said catch means comprises a spring biased catch mounted on said cylinder and having a button protruding through a further aperture in said base, and wherein said locking mechanism and said catch means each are retained in said base by said locking tongue.

28. A cash box as claimed in claim 27, wherein said lid has internal length and width dimensions that are substantially identical or are slightly larger than the external width and length dimensions of said base so that said lip of said lid overhangs said lip of said base and forms a tight, snug overhanging fit with said base when the box is in a closed position, said lip of both said lid and said base being provided with a non-joggled edge.

* * * * *